United States Patent [19]

Lindner

[11] 4,184,117

[45] Jan. 15, 1980

[54] COMMUNICATION SECURITY METHOD AND SYSTEM

[75] Inventor: Herbert G. Lindner, Red Bank, N.J.

[73] Assignee: The United States of America as represented by the Secretary of the Army, Washington, D.C.

[21] Appl. No.: 580,158

[22] Filed: Apr. 16, 1956

[51] Int. Cl.[2] ..... H04K 1/00

[52] U.S. Cl. ..... 325/33; 179/1.5 S; 179/15 R; 325/49; 325/61; 325/370; 325/435

[58] Field of Search ..... 179/1.5, 15.5, 1.5 S, 179/15 R; 250/9 S, 6.9; 178/5.1; 325/32, 33, 49, 61, 370, 435

[56] References Cited

U.S. PATENT DOCUMENTS

| | | | |
|---|---|---|---|
| 2,405,500 | 8/1946 | Guanella | 179/1.5 S |
| 2,510,338 | 6/1950 | Guanella | 179/1.5 R |
| 3,054,857 | 9/1962 | Weiss | 325/33 |

*Primary Examiner*—S. C. Buczinski
*Attorney, Agent, or Firm*—Nathan Edelberg; Sheldon Kanars; Jeremiah G. Murray

EXEMPLARY CLAIM

6. A communication security system including a transmitting system having a plurality of sources of carrier frequencies, a source of prescheduled noise, a suppressed carrier modulator and transmitter responsive to said carrier frequencies and to said prescheduled noise for transmitting only the resultant sidebands, and means for connecting said respective carrier sources to said modulator in accordance with a schedule to be communicated, and a receiving system having a synchronized source of identical prescheduled noise, a receiver multiplier responsive to said sidebands and said prescheduled noise to restore said carrier frequencies, and a plurality of filters each corresponding to one carrier frequency, whereby the outputs of said filters reproduce at said receiving system the schedule communicated from said transmitting system.

6 Claims, 10 Drawing Figures

COMMUNICATION SECURITY METHOD AND SYSTEM

The invention described herein may be manufactured and used by or for the Government for governmental purposes, without the payment of any royalty thereon.

This invention relates to a communication security method and system for transmitting information through any type of communication channel subject to possible eavesdropping and jamming. The use of multiplex transmission of messages is now well known in the art. In one form of such multiplex transmission, known as time multiplex, several messages are transmitted over a signaling system by a sequential selection of successive samples of each message, all transmitted according to a simple, prearranged sequence and provided with a special synchronizing signal in one of the sequential intervals. When the combined signals are received they are separated into the various individual messages by a distributor synchronized to the selector used in the transmitter. Such a system is reasonably secure against casual eavesdropping by ordinary receiving circuits. However, anyone sufficiently interested in making a detailed analysis of the combined signals can determine the necessary characteristics for designing a receiving circuit which will obtain the information.

In some cases the selection is based on a prescheduled rather complex pattern as in Goldsmith U.S. Pat. No. 2,405,252 of Aug. 6, 1946. Such multiplex systems are less subject to eavesdropping but are subject to jamming by any intentional or accidental noise within the frequency band in use. Another form of multiplex transmission over wire circuits is known as frequency multiplex in which the messages are separately transmitted within particular frequency bands. Eavesdropping on such signals is very simple. In the case of wireless transmission this ordinarily is not even considered as a multiplex system since selection of particular frequency bands is nothing more than the normal method of separating various messages from one source or several sources.

In the present invention the message information to be transmitted without jamming or loss in security is distributed randomly in time over several carrier frequency bands and the receiver must be able to analyze this same random time distribution in order to reconstruct the desired signal. The necessary information for determining this random time distribution is also transmitted over a similar plurality of carriers in the form of a prescheduled but apparently meaningless modulation of the same nature as a mere noise signal. The receiver is provided with a similar prescheduled noise signal generator which serves to recognize the particular carrier over which the prescheduled noise signal is being transmitted and accordingly selects the proper channel of the combined signal to reconstruct the original message.

The object of this invention is to provide a fairly simple system for the transmission of the desired message and yet have the combined signal available to jamming or eavesdropping in such a complex form that jamming or analysis and reconstruction of the message to be secured will be entirely impossible, or at least so difficult that the message can be considered entirely secure for all practical purposes.

Further objects of the invention will become apparent in the following description of the invention in connection with the accompanying drawings in which.

Figure 5:
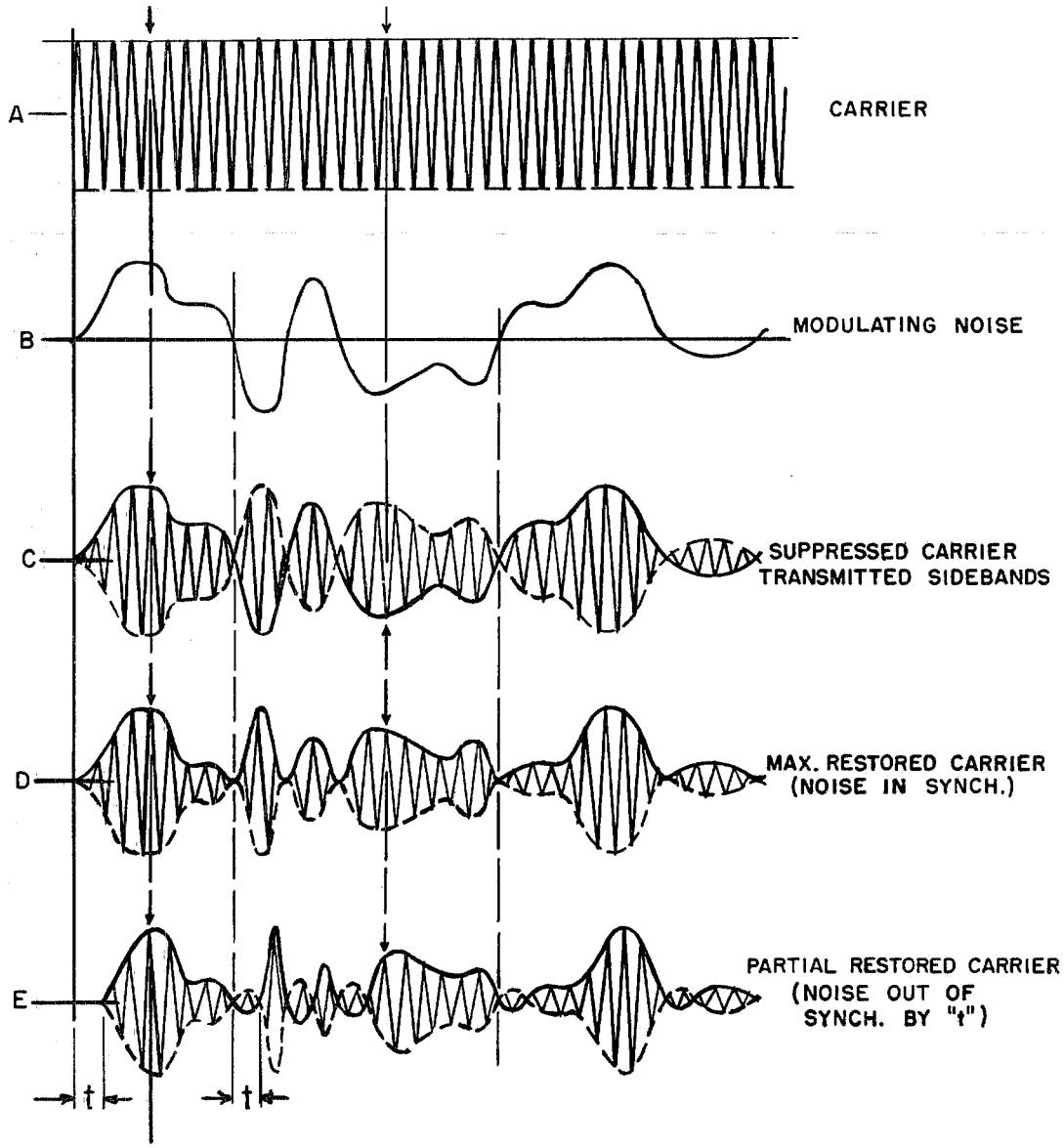
Figure 6:
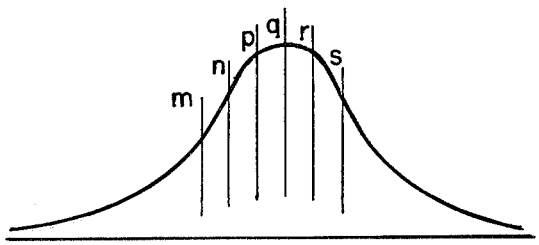

FIG. 5*a–e* represents a small fraction of typical waveforms to explain the operation of correlation, and FIG. 6 represents the amplitude of the correlation function at various phase displacements from synchronization.

Figure 1:
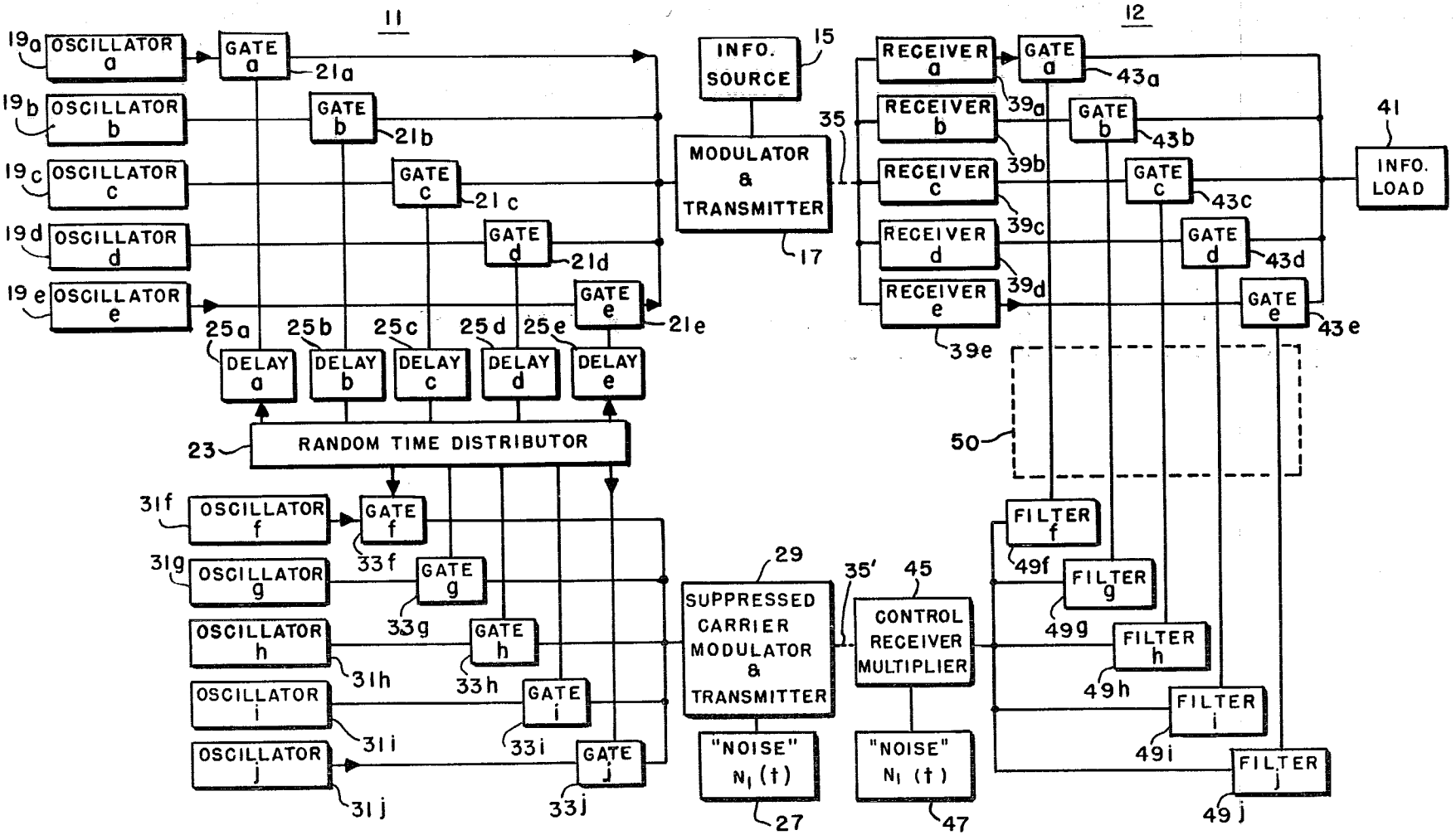
FIG. 1 represents the application of the invention with substantially separate circuits for the message information and for the transmission of the necessary information to maintain synchronism between the distribution of the transmitting and receiving circuits.

In FIG. 1 there is shown a transmitting system 11 and receiving system 12. The transmitting system includes a message information source 15 which provides a suitable input to a modulator and transmitter 17 illustrated as an amplitude modulator. The necessary carriers are supplied to this modulator from a plurality of oscillators 19*a–e* through a similar plurality of gates 21*a–e*. These gates are opened according to an entirely random pattern in time by the random time distributor 23. Delay circuits 25*a–e* between the random distributor and gates are used for a purpose which will become apparent during a discussion of the receiving system. In order to synchronize the operation of the transmitter and receiver distributors a prescheduled noise source 27 indicated as $n_1(t)$ is connected to a suitable modulator and transmitter 29, indicated as a suppressed carrier modulator. This modulator is also supplied with a plurality of other carrier frequencies from oscillators 31*f–j* through a similar plurality of gates 33*f–j*. These gates are directly controlled by the same random time distributor 23 which controls gates 21*a–e* but no delay circuit is included.

At this point it is well to consider the nature of modulators, in which a carrier and modulating signal are combined. Normally both signals would exist in the output, but non-linearities also lead to product terms which can be shown mathematically and actually to include frequency components commonly known as sidebands, of frequencies equal to the sum and difference of the carrier and signal frequencies. Normally the signal frequency is so remote from the others that it is not coupled to the output and only the carrier and sidebands are transmitted. Modulators are also commonly known which are balanced as to the carrier for eliminating the carrier, or even balanced as to both carrier and signal if the signal is in the range of the other frequencies and would not be de-coupled from the output. When the carrier and signal have been eliminated by the balanced modulator or its couplings only the product terms remain and therefore the circuit may be considered as a multiplier.

The omission of the carrier is not immediately obvious in the waveform but careful analysis will show that the apparent carrier is reversed in phase during the times when the modulating signal is negative in sign, as might be expected in a true multiplier. With a sine wave or other simple modulating signal the apparent carrier would reverse phase at each zero amplitude; that is, the modulating signal would be apparent as an envelope of the sidebands if it followed to tops of the in-phase portions of the apparent carrier and the bottoms of the reversed-phase portions. This phase reversal is illustrated in FIG. 5*a* showing a carrier, 5*b* showing a somewhat random modulating signal and 5*c* showing the transmitted product or sidebands. Time reference lines through FIG. 5 help to show the relation of the zero points and phase reversals in the various waveforms. The sidebands alone can be transmitted saving the cost of transmitting carrier energy, but the receiver must reinsert the carrier exactly in proper frequency and phase to recover the modulating signal. Ordinarily a filter is used to exclude one set of sidebands, which merely duplicate the information in the other set, and the reinserted carrier at the receiver may then be permitted to vary slightly from the exact frequency without loss of intelligibility.

It will now be apparent that the apparently random noise $n_1(t)$ is being transmitted at random intervals of time over a plurality of suppressed carrier frequencies and that the message is also being transmitted over a similar plurality of frequencies the periods of transmission of the message over the respective carriers being synchronized with the periods of transmission of the noise over corresponding carriers but occurring slightly later in view of the delay circuits 25. These are transmitted over any suitable medium 35 which may be a radio link, microwave beam, transmission line, or other suitable means. To complicate analysis by potential eavesdroppers the carriers not being used directly for operation may still be transmitted modulated by some signals similar to those in use.

Figure 4:
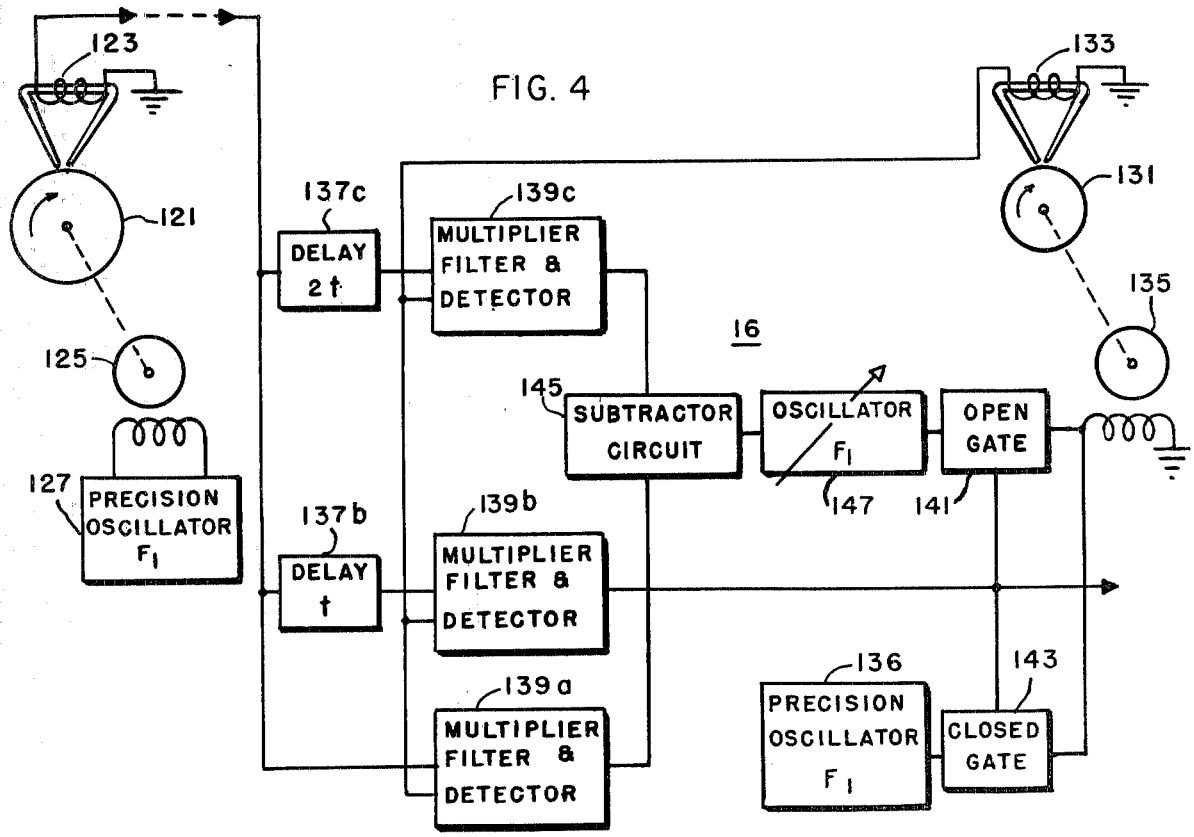
FIG. 4 represents one suitable system for synchronizing the operation of the noise sources used in the transmitting and receiving systems.

In the receiving system receivers 39*a–e* receive all the message information and any other signals or noise coming through the transmitting medium and supply suitable outputs to the message information load 41 through gates 43*a–e* corresponding to the gates 21*a–e* in the transmitting system. To properly control these two sets of gates for sets of gates for proper distribution in synchronism, the receiving system includes another receiver 45 and a prescheduled noise source 47 the same as the source 27 in the transmitting system. These two sources 27 and 47 also require some synchronization by any means such as shown in FIG. 4.

This receiver 45 includes a multiplier circuit for reasons more fully explained below. With the two inputs, one a suppressed carrier signal modulated by the noise function $n_1(t)$ and the other the noise function $n_1(t)$, this multiplier will provide substantial outputs at the same frequency as the carriers which had been suppressed in the transmitter. Filters 49*f–j*, tuned respectively to the same frequency as the oscillators 31*f–j*, supply the necessary control inputs to the gates 43*a–e*. To avoid operation of the gates by carriers improperly received directly over the transmission medium 35' the receiver multiplier preferably should be balanced as to the input signal; balancing as to the noise would not be necessary. Alternatively a carrier suppression filter could be used in the input to the receiver multiplier. The inherent delays in the multiplier, filters, etc., are represented by the dotted block 50; therefore it will be apparent that the delay circuits 25*a–e* and inherent delays 50 can be made equal, so that the distribution of the carriers in the transmitting system is exactly synchronized with the distribution of the outputs of receivers 39*a–e* to be delivered to the message information load 41.

In the case of ordinary suppressed carrier reception the usual analysis is on the basis that the carrier (exactly in phase) is reinserted by addition to give a conventional amplitude modulated signal thereafter detected by a conventional rectifier. If the combined signal is amplified before demodulation this may be the only proper analysis. Usually it is also possible to analyze on the basis that the carrier is reinserted by multiplication giving a new double frequency carrier modulated in accordance with the signal amplitude and superposed on the signal, from which it may be separated by mere filtering.

It will be noted that in the receiver of this system the suppressed carrier of the transmitter is not reinserted as in usual system; instead the prescheduled noise is reinserted by multiplication and, being of lower frequency, there is less difficulty due to shift in frequency and phase. The result of reinserting the noise is that any phase reversals in the apparent carrier are now reinverted so that the entire carrier is restored to proper phase. This is illustrated in FIG. 5*d* in which the carrier phase reversals have been restored to correspond to the original carrier. The varying amplitude is of no importance except to show that the sidebands are now of lesser amplitude than the restored carrier and since these sidebands are derived from random noise they are widely distributed throughout the spectrum so that the restored carrier is the only strong signal at any particular frequency. Analysis would show that the new modulation is merely the square of the original noise signal; mathematically this confirms the restoration of the carrier since all rational numbers whether positive or negative become positive in sign when squared.

The result of a small deviation from synchronism is illustrated in FIG. 5*e* in which it has been assumed that the receiver noise source is slightly delayed by a time t. As a result, when the received signal has first undergone a phase reversal of the apparent carrier the receiver noise source is not yet ready to reinvert, and when the received signal first returns to the normal phase the receiver noise source still causes inversion; therefore at each reversal of the noise polarity a short period t of reversed phase carrier is subtracted from the intended carrier, reducing its average amplitude. If the synchronism is out 1 $\mu$-s the 2-megacycle and 4-megacycle components of the prescheduled noise signal will provide a carrier component in phase opposition to that desired, but 1-megacycle and 3-megacycle components will be in proper phase, and all components below 0.1 megacycle will be near enough in phase.

With a fair distribution of many frequency components in the noise source, the effect of improper synchronization is illustrated quantitatively in FIG. 6 showing the amplitude of the output of the multiplier, filter and detector circuits under various conditions of synchronization. The effect of lead or lag in the receiver noise source would be the same in the case of identical noise sources and substantially the same even if the noise sources varied somewhat. For example, under proper synchronization the output amplitude of a filter might be the point "q" on the correlation curve of FIG. 6. With slight deviation from synchronization, however, the output amplitude might be the points m, n, p, r, or s.

The general shape of the autocorrelation function will vary somewhat with the proportions of various frequency components. High frequencies increase the amplitude of the autocorrelation curve at the exact point of synchronization, while progressively lower frequencies increase the amplitude over ranges progressively further from exact synchronism. Both may be present in varying degrees.

One readily definable type of noise function is a telegraph type signal of equal positive or negative amplitudes with random zero crossings averaging k crossings per second; in this case the autocorrelation function with respect to time displacement t from accurate synchronism is in the shape of the logarithmic decay curve $e^{-2kt}$ having a rather sharp maximum and also a reasonably broad base as might be expected from the fairly uniform distribution of frequency components. This form of noise is of interest since the double modulation at transmitter and receiver will provide a carrier output of unchanging amplitude as far as the double modulation is concerned.

Since the absolute values of the positive and negative terms are the same and the positive and negative signals are both made positive in the squaring operation, the product is of constant magnitude and sign. An article, "Correlation Functions and Communication Applications" by Y. W. Lee and J. B. Wiesner, June 1950 ELECTRONICS, pp 86–92, illustrates correlation of many typical noise waveforms.

As far as this system is concerned the correlation technique depends on multiplying two identical waves of random nature and zero average amplitude, but a carrier serves as a medium to transmit one of said waves. If in phase all original values of whatever polarity will be squared and therefore all positive giving a strong output apparent as a restored carrier. If substantially out of phase the original values will be multiplied and the random polarities of the terms will result in equally random polarities of the products, of zero average amplitude apparent in the fact that the carrier is reversed in phase one-half the time.

The system permits the use of very sharply tuned filters in the receiver so that the signal-to-noise ratio in the distribution control circuits can be very high. Although the system bandwidth is very high, requiring very high power for jamming, the very sharply tuned filters exclude any signals outside the narrow range required at each particular instant for operation of the gating controls. Ordinarily increasing bandwidth requires increase in power and decreases signal-to-noise ratio, but the decreased signal-to-noise ratio and need for greater jamming power are more damaging to eavesdroppers than to those utilizing the system. The only limitation on reducing the filter bandwidth is in permitting the correlation to build up an appreciable output within the available time. For example, if the filter bandwidth were only 100 cycles per second one could not expect to build up an effective output in 1 microsecond, but a filter bandwidth of 10 kilocycles would be quite adequate.

In the foregoing analysis the approach has been largely qualitative. However, for the benefit of those familiar with the quantitative aspects of correlation the following may be found more helpful in some respects.

The sidebands, resulting from the amplitude modulation of an angular carrier frequency by a random noise function of time "n(t)," with the angular carrier frequency suppressed are mathematically expressed as follows:

$$A_o k\,(n(t))\,(\cos w_o t)$$

where $A_o$ is the carrier amplitude, k is the modulation index, and $w_o$ is the angular carrier frequency. If the resulting sidebands are cross multiplied in the receiver multiplier by the receiver stored replicas of the modulating random noise function of time displaced in time by "t'" seconds then the receiver multiplier output is mathematically expressed as follows:

$$A_o k\,(n)t))\,(n(t \neq t'))\,(\cos w_o t)$$

The autocorrelation function of the receiver multiplier output is the following:

$$R(x) = \underset{T-\infty}{\text{Limit}} \frac{1}{2T} \int_{-T}^{T} A_o k(n(t))(n(t \neq t'))(\cos w_o t)\, A_o k(n(t \neq x))(n(t \neq t' \neq x))(\cos w_o(t \neq x))dt$$

Or this can be replaced by the mean value form as follows:

$$(R(x)) = A_o^2 k^2 \overline{(\cos w_o t)(\cos w_o(t \neq x))}\ \overline{(n(t))(n(t \neq t'))(n(t \neq x))(n(t \neq t' \neq x))}$$

Now $$\overline{(\cos w_o t)(\cos w_o(t \neq x))} = \frac{(\cos w_o x)}{2}$$

It is shown by Professor R. M. Fano that $$\overline{(n(t))(n(t \neq t'))(n(t \neq x))(n(t \neq t' \neq x))} = \Phi_n^2(t') \neq \Phi_n^2(x) \neq \Phi_n(x - t')\Phi_n(t' \neq x)$$

where $(\Phi_n(t'))$ is the autocorrelation function of the modulating random noise function of time defined as follows:

$$(\Phi_n(t')) = \underset{T-\infty}{\text{Limit}} \frac{1}{2T} \int_{-T}^{T} (n(t))(n(t \neq t'))dt$$

It follows then that $$(\Phi_n(x)) = \underset{T-\infty}{\text{Limit}} \frac{1}{2T} \int_{-T}^{T} (n(t))(n(t \neq x))dt$$

$$(\Phi_n(x - t')) = \underset{T-\infty}{\text{Limit}} \frac{1}{2T} \int_{-T}^{T} (n(t))(n(t \neq x - t'))dt$$

$$(\Phi_n(x \neq t')) = \underset{T-\infty}{\text{Limit}} \frac{o}{2T} \int_{-T}^{T} (n(t))(n(t \neq x \neq t'))dt$$

Then the autocorrelation function of the receiver multiplier output reduces to the following:

$$(R(x)) = \frac{A_o^2 k^2}{2} (\cos w_o x))((\Phi_n^2(t') \neq (\Phi_n^2(x)) \neq (\Phi_n(x - t'))(\Phi_n(x \neq t')))$$

Professor Wiener has shown that the following relation exists between the autocorrelation function of a function of time and its power spectrum.

$$(W(w)) = 4 \int_0^{\infty} (R(x))(\cos w\, x)dx$$

Hence (W(w)) is the power spectrum of the receiver multiplier output.

$$(W(w)) = 4 \int_0^{\infty} \frac{A_o^2k^2}{2} (\cos w_o x)((\Phi_n^2(t') \neq (\Phi_n(x))$$
$$(\Phi_n(x - t'))(\Phi_n(x \neq t')))(\cos w\, x)dx$$

Or $$(W(w)) = A_o^2k^2 \int_0^{\infty} (\cos(w_o \neq w)x)((\Phi_n^2(t')) \neq$$
$$(\Phi_n^2(x)) \neq (\Phi_n(x - t'))(\Phi_n(x \neq t')))dx \neq$$
$$A_o^2k^2 \int_0^{\infty} (\cos(w_o - w)x)((\Phi_n^2(t')) \neq (\Phi_n^2(x)) \neq$$
$$(\Phi_n(x - t'))(\Phi_n(x \neq t'))) dx$$

When the spectral width of the modulating random noise function of time is much less than the carrier frequency $f_o$, then the contribution of the first term can be neglected and hence the receiver multiplier output power spectrum becomes the following:

$$(W(w)) = A_o^2k^2 \int_0^{\infty} ((\Phi_n^2(t')) \neq (\Phi_n^2(x)) \neq (\Phi_n(x - t'))$$
$$(\Phi_n(x \neq t')))(\cos(w_o - w)x)\, dx$$

Or $$(W(w)) = A_o^2k^2 \int_0^{\infty} (\Phi_n^2(t'))(\cos(w_o - w)x)\, dx \neq$$
$$A_o^2k^2 \int_0^{\infty} (\Phi_n^2(x))(\cos(w_o - w)x)\, dx \neq$$
$$A_o^2k^2 \int_0^{\infty} (\Phi_n(x - t'))(\Phi_n(x \neq t')(\cos(w_o - w)x)\, dx$$

Or $$(W(w)) = A_o^2k^2(\Phi_n^2(t'))(D(w_o - w)) \neq$$
$$A_o^2k^2 \int_0^{\infty} (\Phi_n^2(x))(\cos(w_o - w)x)\, dx \neq$$
$$A_o^2k^2 \int_0^{\infty} (\Phi_n(x - t'))(\Phi_n(x \neq t'))(\cos(w_o - w)x)\, dx$$

where $(D(w_o - w))$ is the Dirac-Delta function which is unity when $w_o = w$ and is zero when $w_o \neq w$. The energy is the receiver multiplier output at the angular carrier frequency becomes the following:

$$(W(w_o)) = A_o^2k^2(\Phi_n^2(t')) \neq$$
$$A_o^2k^2 \int_0^{\infty} (\Phi_n^2(x))\, dx \neq$$
$$A_o^2k^2 \int_0^{\infty} (\Phi_n(x - t'))(\Phi_n(x \neq t'))\, dx$$

When the transmitter modulating random noise function of time is in time synchronism with the receiver stored replica of the modulating random noise function of time, then t' is zero and hence $$(W(w_o)) = A_o^2k^2(\Phi_n^2(o)) \neq 2A_o^2k^2 \int_0^{\infty} (\Phi_n^2(x))\, dx$$

The receiver multiplier output energy spectral density for any frequency other than $w_o$, that is $w \neq w_o$, is the following:

$$(W(w)) = A_o^2k^2 \int_0^{\infty} (\Phi_n^2(x))(\cos(w_o - w)x)dx \neq$$
$$A_o^2k^2 \int_0^{\infty} (\Phi_n(x - t'))(\Phi_n(x \neq t'))(\cos(w_o - w)x)dx$$

Again when the transmitter modulating random noise function of time is in time synchronism with the receiver stored replica of the modulating random noise function of time and $w \neq w_o$, then $$(W(w)) = 2A_o^2k^2 \int_0^{\infty} (\Phi_n^2(x))(\cos(w_o - w)x)dx$$

$$(W(w_o)) = A_o^2k^2(\Phi_n^2(o)) \neq 2A_o^2k^2 \int_0^{\infty} (\Phi_n^2(x))dx >> \quad t' = o$$

$$2A_o^2k^2 \int_0^{\infty} (\Phi_n^2(x))(\cos(w_o - w)x)dx = (W(w)) \quad w \neq w_o,\ t' = o$$

As an example, if the modulating random noise function of time were the output from an RC filter whose cutoff frequency is $a_n$ and whose input is random white noise of power density $N_o$, then the autocorrelation function of the RC filter output is the following:

$$(\Phi_n(t')) = \frac{N_o a_n}{2} (e^{-a_n/t'/})$$

Then $$(\Phi_n^2(t')) = \frac{N_o^2 a_n^2}{4} (e^{-2a_n/t'/})$$

And $$(\Phi_n^2(o)) = \frac{N_o^2 a_n^2}{4}$$

Also $$\int_0^{\infty} (\Phi_n^2(x))dx = \int_0^{\infty} \frac{N_o^2 a_n^2}{4} (e^{-2a_n/x/})dx = \frac{N_o^2 a_n}{8}$$

And $$\int_0^{\infty} (\Phi_n^2(x))(\cos(w_o - w)x)dx =$$
$$\int_0^{\infty} \frac{N_o^2 a_n^4}{4} (e^{-2a_n/x/})(\cos(w_o - w)x)dx =$$
$$\left(\frac{2a_n}{4a_n^2 \neq /w_o - w/^2}\right) \frac{N_o^2 a_n^2}{4}$$

It follows then that $$(W(w_o)) = \left(\frac{A_o^2k^2N_o^2a_n^2}{4} \neq \frac{A_o^2k^2N_o^2a_n}{4}\right) >> \quad t' = o$$
$$N_o^2a_n^2 \left(\frac{a_n}{4a_n^2 \neq /w_o - w/^2}\right) A_o^2k^2 = (W(w)) \quad w \neq w_o,\ t' = o$$

Figure 2:
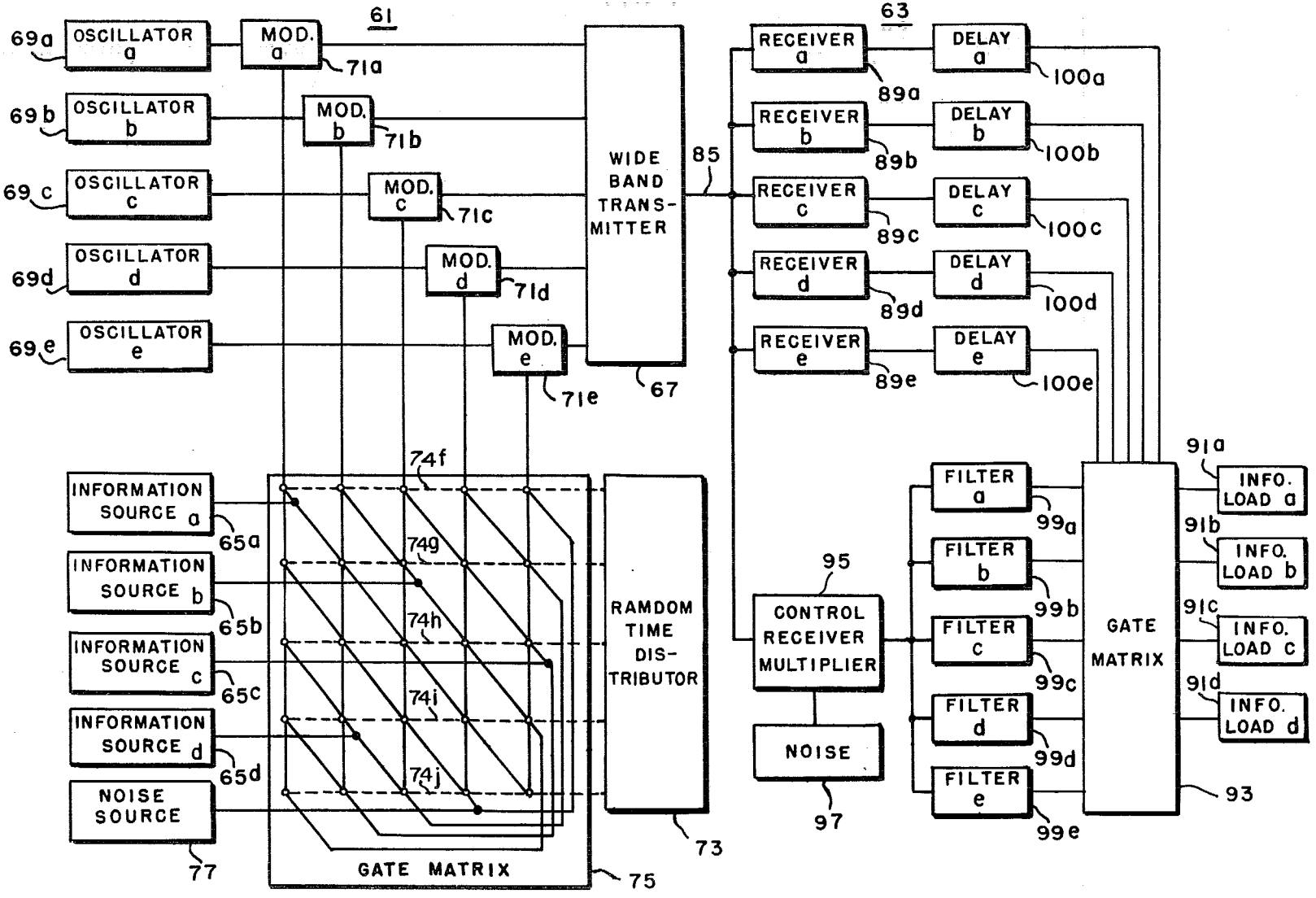
FIG. 2 represents a more involved application of the invention in which the same carrier frequencies are used for the message, for synchronizing the distribution, and for multiplexing of further messages for more efficient usage of the communication facilities.

The somewhat more complex system of FIG. 2 also includes a transmitting system 61 and receiving system 63 corresponding generally to the system of FIG. 1. In this modification of the invention a plurality of message information sources 65*a–d* and a prescheduled noise source 77 are used to modulate the carriers supplied to the transmitter 67. A plurality of carrier frequency oscillators 69*a–e* supply the necessary carriers for the several bands of energy to be transmitted. Each of the carriers is provided with a suitable modulator 71*a–e* shown as single sideband modulators. The use of signal sideband in such a system is helpful to reduce transmitted signal energy and to prevent analysis by eavesdroppers since the two "reflected" components of the double sideband might be of some value in identifying the carriers and then further analyzing or jamming the signals.

The modulators are supplied from the various message information sources 65*a–d* and the prescheduled noise source 77 through a gate matrix 75 which is controlled according to a random pattern in time from the random time distributor 73. As illustrated in the diagram the gate matrix is arranged in a cyclic pattern so that with the output 74*f* of the random time distributor energized the information sources 65*a–d* are connected through the gate matrix directly to the modulators 71*a–d* respectively and the source of prescheduled noise 77 is connected to modulator 71*e*. When the energization shifts to the output 74*g* of the random distributor the information sources 65*a–d* are connected to modulators 71*b–e* respectively, noise source 77 to modulator 71*a*, and so on. The operation of the random time distributor 73 is sufficiently unpredictable to make analysis by an eavesdropper practically impossible. However, the gate matrix itself may also be made somewhat random to further complicate any attempt at analysis. The modulated carrier waves are combined in the wideband transmitter 67 and transmitted through the medium 85 to the receiving system 63.

In the receiving system a plurality of receivers 89*a–e* are responsive to the respective sidebands from the oscillators 69*a–e* and their respective modulators 71*a–e*. The outputs of these receivers are connected through delay circuits 100*a–e* to a synchronized gating matrix 93 in which the signals are distributed to the respective message information loads 91*a–d*. This matrix must correspond exactly to the matrix 75 of the transmitter except that the prescheduled noise which would be received on the fifth output of the matrix would have no purpose and therefore may be eliminated. A receiver multiplier 95 is also provided with a series of filters 99*a–e* in which the restored carriers resulting from multiplying by a local source of prescheduled noise 97 are identified. Any one of the filters 99*a–e* is actuated to provide an output to the gate matrix 75 when the prescheduled noise from the local source 97 corresponds to the particular carrier modulated by the prescheduled noise as received over the signal medium 85. The inherent delays in the operation of the receiver multiplier 95, the filters 99*a–e*, and the gate matrix 75 are balanced by the delays in the signal channels through delay circuits 100*a–e* so that the initial portions of each fragment of the message received over the particular receivers 89*a–e* are not lost in the gating operation.

It will be apparent that the sequence of many operations is interchangeable. For example, the appropriate gates may control unmodulated carriers as shown in FIG. 1, the modulating message as in FIG. 2, or even the carriers after modulation, and may control the audio signals as in the receiver of FIG. 1 or 2 or the radio frequency or intermediate frequency which will provide the audio signals (at least a wideband radio frequency preampliifer would probably be used before the gates). Similarly the delays may be in the transmission system as in FIG. 1 or in the receiving system as in FIG. 2. The system may also use amplitude modulation as in part of FIG. 1, suppressed carrier modulation as in another part of FIG. 1, or even single sideband modulation as in FIG. 2, or other forms of modulation. If allowance is made for transmission delays the single distribution synchronizing system can control the outgoing information as shown and also incoming information from the opposite end of the system. Combined transmitters and receivers commonly known as transceivers are readily adaptable to such a system.

Figure 3:
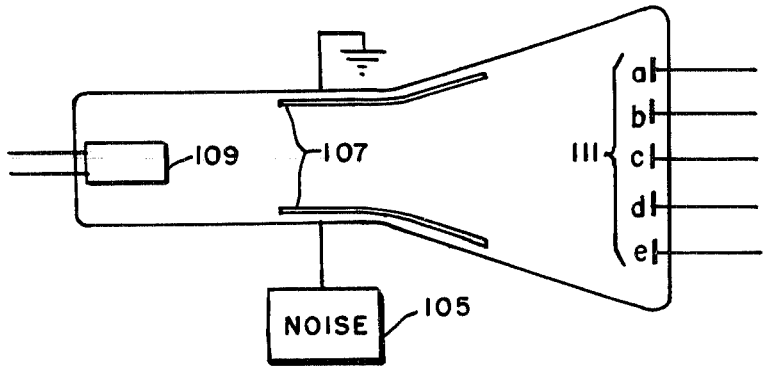
FIG. 3 represents a suitable random time distributor which might be used with this invention.

In FIG. 3 there is shown a random noise source 105 connected to the sweep electrodes 107 of a cathode ray type commutator 101 having an electron gun 109 and output electrodes 111*a–e*. The random noise supplied to the sweep electrodes will provide a random time distribution by quantizing the effect of the noise signal on the various output electrodes in a random manner.

In FIG. 4 the source of noise $n_1(t)$ is shown as a magnetic drum 121 provided with a pickup head 123 and driven by a synchronous motor 125 controlled by a high precision oscillator 127 of frequency $f_1$. The receiving system is provided with an identical magnetic drum 131, pickup head 133, synchronous motor 135, and high precision oscillator 137 of the same frequency as the oscillator in the transmitting system. Since even high precision oscillators are likely to drift somewhat over long periods of time and the transmission system itself may involve small variations in the delay time of the transmitted information, some synchronizing control may be desirable. The incoming signal may be supplied directly and through delay circuits 137*b* and *c*, providing delays t and 2*t* respectively, to three multiplier, filter, and detector circuits 139*a*, *b*, and *c*. These multiplier circuits are also supplied from the pickup head 133. The multipliers, filters, and detectors provide substantial outputs when the noise modulation on the received signals and the local noise signals substantially coincide in time. The output of multiplier, filter, and detector 139*b* is intended to be the maximum (point q of FIG. 6) with the signal from transmitter pickup head through delay 137*b* synchronized with the signal from receiver pickup head 133. The outputs of multiplier, filter, and detector circuits 139*a* and *c* would both be somewhat smaller and equal in magnitude (points n and s of FIG. 6) since the direct signal and the signal supplied through delay circuit 137*c* are each equally displaced in time from the local signal.

The outputs of 139*a* and *c* are supplied to a subtractor circuit 145 from which the difference (such as points n and r of FIG. 6), either positive or negative, is supplied to a variable frequency oscillator 147 of the same normal frequency as the precision oscillator 136, but including a reactance tube to modify the frequency. The output of 139*b* is connected to open a normally closed gate for disconnecting the precision oscillator from the synchronous motor 135 and to close a normally open gate for substituting the variable frequency oscillator 147. Therefore temporary differences in the outputs of 139*a* and *c* will not control the synchronous motor unless the amplitude of the signal in 139*b* is substantial. If components of this synchronizing system are also used to control one of the information gates 43*a–e* in FIG. 1, this same output of 139*b* would be used for the purpose. With no incoming signal the precision oscillator 136 remains connected to the synchronous motor, or when properly synchronized the oscillator 147 operates at the same frequency, but in case the signal from receiver drum 131 is ahead of that supplied by drum 121 a slightly lower frequency is applied to the synchronous motor from source 147, and in case the drum 131 is behind, a slightly higher frequency is applied. The part-time synchronization accomplished in any one of the control channels is sufficient to maintain synchronism through the periods when the other control channels are operative even if different prescheduled noise sources are used for each carrier to further complicate analysis and jamming.

An elementary form of the invention and a typical application to a complex system have been described to facilitate an understanding of the invention, but many further variations will be apparent to those skilled in the art.

What is claimed is:

1. A communication security system comprising an information transmitting station and an information receiving station coupled by communication channel carriers, said transmitting station comprising selector means to successively modulate the carriers in one plurality of said channels by a source of information according to a random pattern in time, said receiving station comprising means to receive energy from said channels, means to separate the energy from said channels modulated by information, a load responsive to the information, selector means to select for said load the energy from said channels modulated by information according to the same random pattern in time as used in said transmitting station, a selector control system comprising one of said selector means to successively modulate the carriers in another plurality of said channels by a source of prescheduled noise according to the same random pattern in time at one of said information stations, the carriers in said other plurality of channels being suppressed in the modulation and at the other of said information stations a second source of prescheduled noise the same as said first source, receiver multiplier means responsive to said second source of prescheduled noise and the energy from said channels modulated by noise to restore the suppressed carriers, and filter means responsive to said restored carriers to control said other selector means according to the same random period in time.

2. A communication system as in claim 1 including means for delaying the time pattern of said information to compensate any delays in the receiver, multiplier, and filter, whereby the completeness of the transmitted information is maintained.

3. A communication security system comprising a selector transmitting system and a selector receiving system coupled by communication channel carriers, and an information transmitting system and information receiving system at the same points also coupled by communication channel carriers, said selector transmitting system comprising means to successively modulate and suppress the carriers in a plurality of said channels by a source of prescheduled noise according to a random pattern in time, also used by an information selector means, said selector receiving system comprising a second source of prescheduled noise the same as in said selector transmitting system, receiver multiplier means responsive to said second source of prescheduled noise and the energy from said channels modulated by noise to restore the suppressed carriers, and filter means responsive to said restored carriers to control an information selector means according to the same random pattern in time as in said selector transmitting system, said information transmitting system comprising one of said information selector means to successively modulate the carriers in one plurality of said channels by a source of information according to the same random pattern in time, and said information receiving system comprising means to receive energy from said channels, means to separate the energy from said channels modulated by information, a load responsive to the information, and the other of said information selector means to select for said load the energy from said channels modulated by information according to the same random pattern in time as used in said transmitting system.

4. A communication system as in claim 3 including means for delaying the time pattern of said information to compensate any delays in the selector receiver multiplier and filter, whereby the completeness of the transmitted information is maintained.

5. A communication security system comprising a transmitting station and a receiving station coupled by communication channel carriers, said transmitting station comprising means to successively modulate the carriers in a plurality of said channels by a source of information according to a random pattern in time, and means to successively modulate and suppress the carriers in a plurality of said channels by a source of prescheduled noise according to the same random pattern in time, said receiving station comprising means to receive energy from said channels, means to separate the energy from said channels modulated by information, a load responsive to the information, means to select for said load the energy from said channels modulated by information according to the same random pattern in time as used in said transmitting station, a second source of presheduled noise the same as used in said transmitting station, receiver multiplier means responsive to said second source of prescheduled noise and the energy from said channels modulated by noise to restore the suppressed carriers, and filter means responsive to said restored carriers to control said selector means, said communication system including means for delaying the time pattern of said information to compensate any delays in the receiver, multiplier and filter, whereby the completeness of the transmitted information is maintained.

6. A communication security system including a transmitting system having a plurality of sources of carrier frequencies, a source of prescheduled noise, a suppressed carrier modulator and transmitter responsive to said carrier frequencies and to said prescheduled noise for transmitting only the resultant sidebands, and means for connecting said respective carrier sources to said modulator in accordance with a schedule to be communicated, and a receiving system having a synchronized source of identical prescheduled noise, a receiver multiplier responsive to said sidebands and said prescheduled noise to restore said carrier frequencies, and a plurality of filters each corresponding to one carrier frequency, whereby the outputs of said filters reproduce at said receiving system the schedule communicated from said transmitting system.

* * * * *